US006640824B2

(12) United States Patent
Majkovic

(10) Patent No.: US 6,640,824 B2
(45) Date of Patent: Nov. 4, 2003

(54) MUD SAVER KELLY VALVE

(75) Inventor: Davor Majkovic, Edmonton (CA)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/905,133

(22) Filed: Jul. 13, 2001

(65) Prior Publication Data

US 2001/0037900 A1 Nov. 8, 2001

Related U.S. Application Data

(62) Division of application No. 09/293,548, filed on Apr. 16, 1999, now Pat. No. 6,289,911.

(51) Int. Cl.[7] ..... F16K 17/16; E21B 34/08

(52) U.S. Cl. ..... 137/71; 137/355.33; 166/317; 166/325

(58) Field of Search ..... 137/71, 68.23, 137/315.33; 166/317, 332.2, 332.7, 324, 325

(56) References Cited

U.S. PATENT DOCUMENTS 1,571,022 A * 1/1926 Obert ..... 137/71
2,562,672 A * 7/1951 Kunert et al. ..... 137/71
3,693,644 A * 9/1972 Dilorenzo ..... 137/71
3,698,411 A * 10/1972 Garrett ..... 137/71
3,967,679 A * 7/1976 Liljestrand ..... 166/317
4,364,407 A * 12/1982 Hilliard ..... 166/317 X
4,625,755 A * 12/1986 Reddoch ..... 166/325 X
4,687,421 A * 8/1987 Cameron et al. ..... 137/71 X
4,955,949 A * 9/1990 Bailey et al. ..... 166/317 X

* cited by examiner

*Primary Examiner*—John Rivell
(74) *Attorney, Agent, or Firm*—Conley Rose, P.C.

(57) ABSTRACT

A mud saver valve is described that features an outer housing that retains upper and lower valve pistons therewithin. The pistons coordinate to provide a check valve so that fluid, such as drilling mud, is permitted to flow in one direction while under pump pressure and works as a relief valve in the event of excessive wellbore pressure when the pump is turned off. Both pistons are provided with apertured plates that selectively define fluid passages through the valve. In the described embodiment, the valve also includes a frangible vent cap that is self-securing and easily replaceable. The cap permits venting of excessive downhole pressures.

16 Claims, 2 Drawing Sheets

MUD SAVER KELLY VALVE

CROSS-REFERENCE TO RELATED APPLICATIONS

This is a divisional continuing application of U.S. patent application Ser. No. 09/293,548, filed Apr. 16, 1999 now U.S. Pat. No. 6,289,911.

STATEMENT REGARDING FEDERALLY SPONSORED RESEARCH OR DEVELOPMENT

Not Applicable.

BACKGROUND OF THE INVENTION

1. Field of the Invention

The present invention relates generally to fluid valve arrangements that permit flow under pump pressure and automatically close against flow when the pump is turned off. In one preferred aspect, the invention relates to mud saver valves of the type used in oil drilling operations. In other aspects, the invention relates to knockout caps useful for such mud saver valves.

2. Background of the Invention

It is standard practice in drilling operations to insert a mud saver valve between the kelly and the drill pipe in order to help prevent loss of drilling mud when the connection between the kelly and the drill pipe is broken. The recognized advantages of such valves include the saved cost of lost drilling mud, less pollution and greater safety for drilling rig personnel since less lost mud results in fewer slippery floors and surfaces in the rig.

Conventional mud saver valves incorporate a spring-biased check-valve or poppet-type valve that opens to permit mud flow downwardly into the drill pipe. When the mud flow is turned off, the spring biases the poppet valve closed so that mud cannot pass through the valve.

Unfortunately, conventional poppet-type mud saver valves usually need to be machined to close tolerances and may be susceptible to wear from the abrasive muds that are passed through them, particularly around the area of the valve seat. Over time, this wear can deteriorate the ability of the valve to seal. Also, if the seals of the poppet valve have a slight leak, the valve will likely not seal properly, and under pump pressure, the valve may begin throttling in an undesirable manner. The valve seat may also be vulnerable to impact damage.

In addition, under normal operating conditions when such a valve is open, turbulent flow develops through the valve body which leads to washing out or eroding of portions of the valve body. This turbulence results at least partially because fluid passing through these types of valves is directed radially outwardly through the space between the valve body and the valve seat, thus changing the direction of flow. Further, the flow is often directed toward and into the walls of the flowbore, creating further turbulence in the flow.

Vent caps are known for use in mud saver valves. These caps permit venting of excessive downhole pressure through the kelly valve. Some vent caps are designed to be broken away in the event that it is desired to pass tools downward through the mud saver valve. One such cap is disclosed in U.S. Pat. No. 3,965,980 issued to Williamson. In order to replace this type of cap, however, stop pins must be removed from the guide and cap. The cap then is removed. Afterward, the cap must be replaced and the stop pins replaced.

Other vent caps are known that are removable from the kelly valve in the event that tools must be passed downward through the kelly valve. A vent cap of this type is described in U.S. Pat. No. 4,364,407. Unfortunately, a wireline tool is required in order to remove the cap from the valve and then to replace it later.

A need exists for improved mud saver valves that can more effectively resist wear from abrasive drilling muds. A need also exists for an improved knockout cap that can be easily replaced and does not require stop pins or other connectors to hold it in place during operation.

SUMMARY OF THE INVENTION

The present invention provides a mud saver valve that features an outer housing or sub that retains upper and lower valve pistons. The pistons are reciprocably disposed within the housing and coordinate to provide a check valve though which fluid, such as drilling mud, is permitted to flow in one direction under pump pressure. Both the upper and lower valve pistons are provided with apertured plates that can be aligned in order to selectively open or close fluid passages defined by the apertures.

The valve configuration generates largely laminar flow through the valve. Turbulence is minimized because the direction of flow is not changed by the valve components.

In the preferred embodiment described here, the upper piston is disposed within the housing so that axial movement of the upper valve piston within the housing will also rotate the upper valve piston within the housing. In the described embodiment, a camming action is provided to rotate the upper piston within the housing and close the ports. The plates are secured within the piston sleeves using a keying arrangement. The plates are readily replaceable.

In operation, the spring causes axial movement of the piston sleeves within the housing and, thus, angular rotation of the plates with respect to one another, thereby opening a plurality of fluid flow ports to permit flow therethrough.

The invention also describes a frangible knockout vent cap that is readily replaceable and self-securing. The cap permits venting of excessive downhole pressure.

BRIEF DESCRIPTION OF THE DRAWINGS

For an introduction to the detailed description of the preferred embodiments of the invention, reference is made to the following accompanying drawings wherein.

DETAILED DESCRIPTION OF THE PREFERRED EMBODIMENTS

Figure 1:
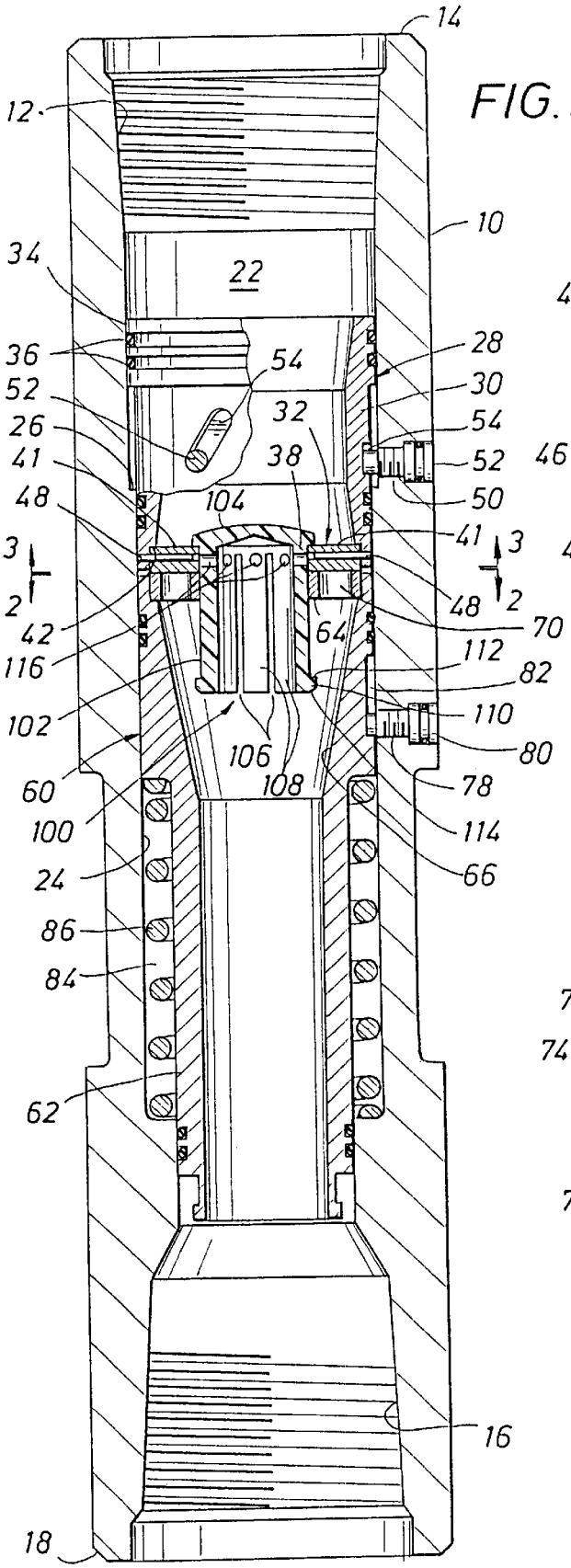
FIG. 1 is a side cross-section depicting an exemplary mud saver valve constructed in accordance with the present invention. The valve is shown in a closed position.

Referring to FIGS. 1–6, an exemplary mud saver valve is depicted which is constructed in accordance with the present invention. A tubular body 10 is shown having a threaded box connector 12 at its upper end 14 and a threaded box connector 16 at its lower end 18.

An interior flow bore 20 is defined along the length of the body 10 made up of an upper, enlarged-diameter polished bore section 22, and a reduced diameter lower section 24. An upwardly-facing annular shoulder 26 is located between the upper and lower bore sections 22, 24.

An upper piston 28 is reciprocably retained within the flow bore 20. The upper piston 28 generally includes a tubular sleeve 30 and a flat circular plate 32. The tubular sleeve 30 includes an upper, enlarged portion 34 which is adapted to fit within the upper bore section 22. A plurality of annular seals 36 are secured around the circumference of the enlarged portion 34 to assist in created a fluid seal between the enlarged portion 34 and the upper bore section 22.

Figure 2:
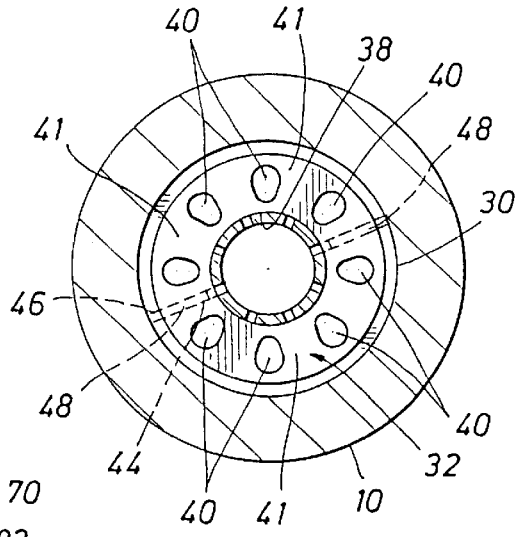
FIG. 2 is a cutaway view of the valve taken along the line 2—2 in FIG. 1.

As FIGS. 1 and 2 illustrate, the plate 32 contains a central opening 38. A plurality of surrounding apertures 40 are also provided in the plate 32. In this case, there are eight apertures 40. Plate portions 41 are located between each pair of apertures 40. It should be understood that there could be more such apertures or fewer, although eight apertures are currently preferred.

The circular plate 32 is secured to the sleeve 30 within a complimentary recess 42. A keying arrangement is used to secure the plate 32 within the recess 42. In the described embodiment, the keying arrangement employs pin passages 44, 46 disposed in the plate 32 and sleeve 30, respectively. The pin passages 44, 46 are coaxially aligned, as shown in FIG. 2 so that a pin 48 can be inserted into the two passages, thus securing the plate 32 and sleeve 30. As shown in FIG. 2, there are two sets of pin passages 44, 46 and two pins 48.

The outer housing 10 includes three upper apertures 50 spaced at approximately 120° from one another around the periphery of the housing 10. Camming pins 52 are disposed through the apertures 50 and reside within angled slots 54 in the outer surface of the sleeve 30 of upper piston 28. The camming pins 52 cause rotation of the upper piston 28 within the housing 10 when the upper piston 28 is moved axially within the housing 10.

A lower piston 60 is disposed below the upper piston 28 within the valve housing 10. The lower piston 60 is formed from a generally tubular piston sleeve body 62 and a flat circular plate 64. The sleeve body 62 includes an axial fluid flowbore 66 disposed therethrough. Preferably, the inner surface of the flowbore 66 is coated with chrome or another finish to prevent frictional resistance to fluid flow along the flowbore 66.

Figure 3:
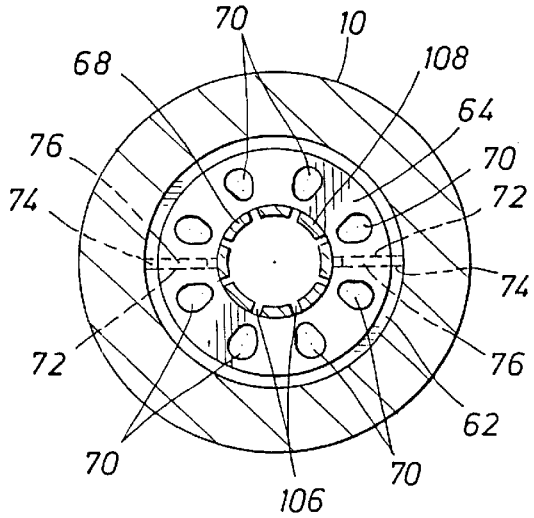
FIG. 3 is a cutaway view of the valve taken along the line 3—3 in FIG. 1.

The circular plate 64 is nearly identical to the circular plate 32 described above. The plate 64 also contains a central opening 68 and a plurality of radially disposed apertures 70. Eight such apertures 70 are shown in FIG. 3. It is pointed out that the number of apertures 70 should equal the number of apertures 40 in the circular plate 32.

Just as with the upper piston 28, a keying arrangement is used to secure the circular plate 64 within the sleeve body 62 of the lower piston 60. Pin passages 72, 74 are disposed in the plate 64 and sleeve body 62, respectively. The pin passages 72, 74 are coaxially aligned, as shown in FIG. 3 so that a pin 76 can be inserted into the two passages, thus securing the plate 64 and sleeve body 62. As shown in FIG. 3, there are two sets of pin passages 72, 74 and two pins 76.

Three lower apertures 78 are included through the outer housing 10. Like the upper apertures 50, the lower apertures 78 are spaced at approximately 120° from one another around the periphery of the housing 10. Alignment pins 80 are disposed through the apertures 78 and reside within vertically-oriented slots 82 in the outer surface of the sleeve body 62 of the lower piston 60. The alignment pins 80 function to prevent rotation of the lower piston 60 with respect to the housing 10. It is also noted that the slots 82 might be angled in a direction opposite that of angled slots 54.

An annular spring chamber 84 is defined between the sleeve body 62 of the lower piston 60 and the outer housing 10. A compressible spring 86 is disposed within the chamber 84 and biases the upper and lower pistons 28, 60 upwardly. The spring 86 should provide adequate closing force to ensure closure of the valve against the force provided by a static load from the kelly hose (not shown) above the valve being filled with mud. The spring chamber is filled with air at atmospheric pressure. The spring 86 should compress as the lower piston 60 is moved downwardly within the housing 10 to allow the valve to open when mud is pumped down through the valve under pressure.

The circular plates 32, 64 are urged against one another by the spring 86. The sleeve bodies 30, 62 of the two pistons 28, 60 do not contact one another. As a result, the entire spring force is transferred directly through the plates 32, 64, thereby assuring a better fluid seal.

FIGS. 1–3 depict the valve assembly in a closed configuration wherein fluid flow across the valve is blocked. The valve will be in this configuration absent downward fluid flow through the bore 22 such that fluid pressure above the valve exceeds the pressure provided by the static mud load on the valve with the mud pumps turned off. The spring 86 biases the upper and lower pistons 28, 60 upward thereby camming the upper piston 28 angularly so that the upper piston 28 is rotated within the housing 10. When this occurs, the plate portions 41 are aligned with the apertures 70 of the lower plate 64. The apertures 40 of the upper plate 32 are also positively closed against fluid flow therethrough by complimentary plate portions of the lower plate 64. Wear around the periphery of the apertures 40, 70 is unlikely to result in deterioration of the valve's ability to seal since there is no peripheral seal to be worn away.

Figure 4:
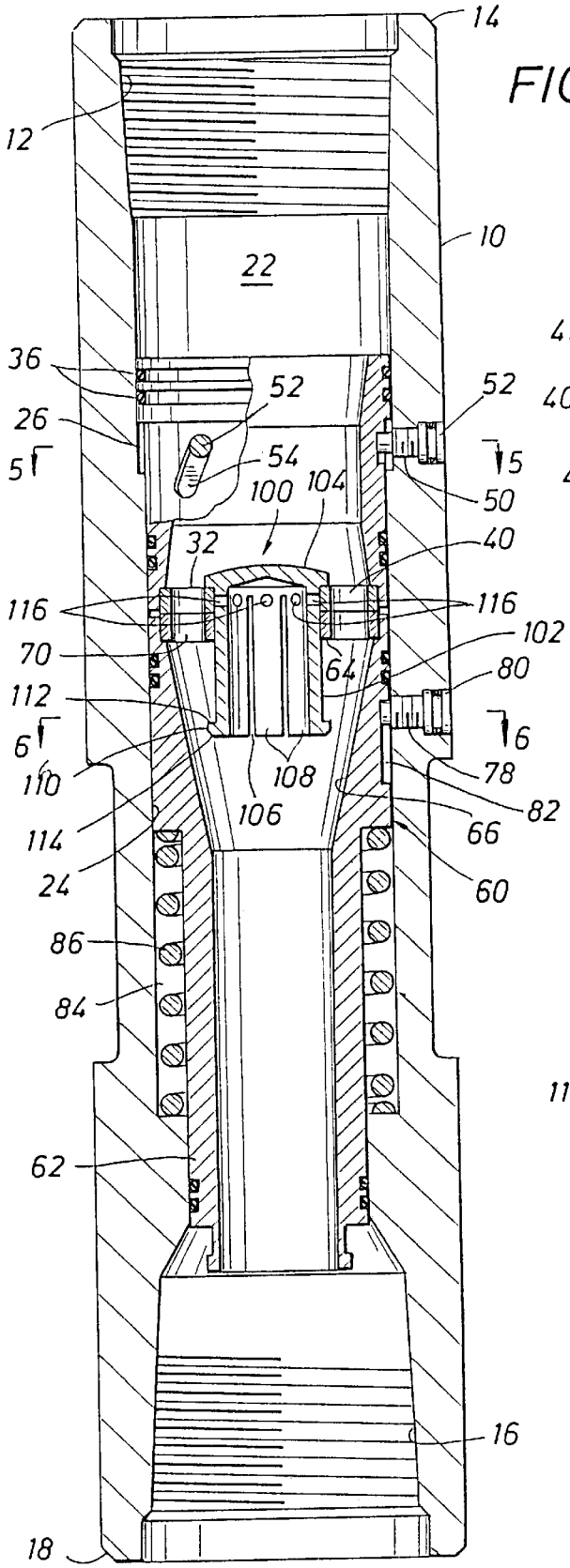
FIG. 4 is a side cross-section of the valve shown in FIG. 1 with the valve in an open position.
Figure 5:
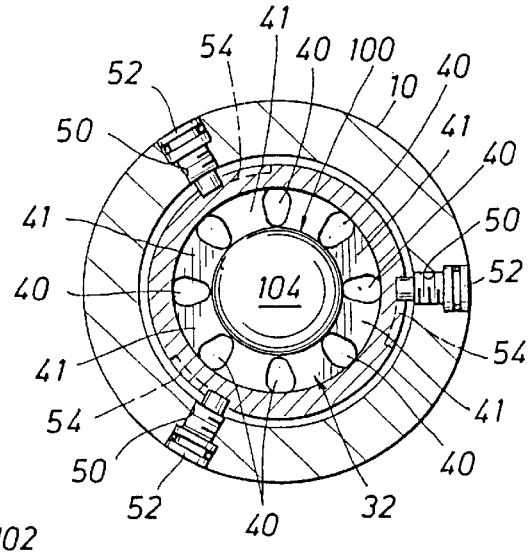
FIG. 5 is a cutaway view of the valve taken along the line 5—5 in FIG. 4.
Figure 6:
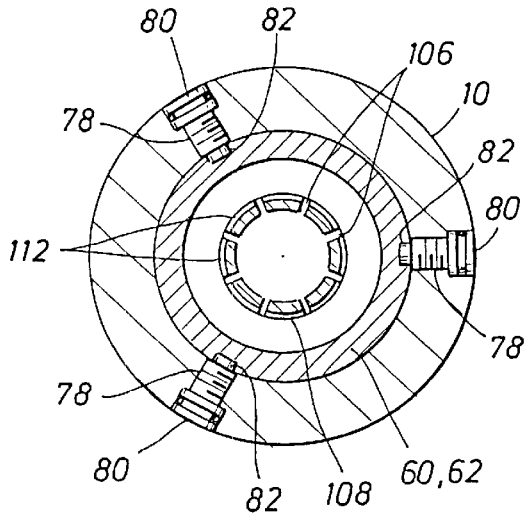
FIG. 6 is a cutaway view of the valve taken along the line 6—6 in FIG. 4.

FIGS. 4–6 depict the valve assembly in an open position such that fluid is capable of flowing through the aligned apertures 40, 70 of the plates 32, 64. As shown clearly in FIG. 4, fluid passages are defined by the aligned apertures 40, 70 in the plates 32, 64. Drilling mud can be pumped downwardly through these fluid passages.

The valve is easily moved from the closed position shown in FIGS. 1–3 to the open position depicted in FIGS. 4–6 by increasing fluid pressure above the valve. An increase in fluid pressure is normally accomplished by turning on the mud pumps used to pump drilling mud downward through the flowbore 22. As fluid pressure is increased, the upper and lower pistons 28, 60 are urged downwardly within the housing 10. The spring 86 is compressed within the spring chamber 84. As the upper piston 28 is moved downwardly within the housing 10, the camming pin 52 moves within the slot 54 to the position shown in FIG. 4 thereby causing the upper piston 28 to rotate with respect to the housing 10. Rotation of the upper piston 28 causes the apertures 40 in the upper plate 32 to become aligned with the apertures 70 in the lower plate 64 thereby forming fluid passages which permit the communication of fluid through the upper and lower plates 32, 64. It is noted that fluid flow through the aligned apertures 40, 70 will be substantially laminar rather than turbulent.

Upon a reduction of fluid pressure above the valve, the spring 86 will urge the upper and lower pistons 28, 60 upwardly within the housing 10. The camming pin 52 will move within the slot 54 to the position shown in FIG. 1. Again, the upper piston 28 will be rotated with respect to the housing 10. The apertures 70 of the lower plate 64 will be covered by the plate portions 41 of the upper plate 32, closing them against fluid flow.

The lower piston 60 can be thought of as a translational member in that it translates axially within the housing 10 without rotating with respect to the housing 10. The upper piston 28 can be thought of as a rotational member because it will be rotated with respect to the housing 10 when it is moved axially within the housing 10.

A frangible vent cap 100 is disposed within the openings 38, 68 of the two circular plates 32, 64. The cap 100 includes a generally cylindrical elongated body 102 with a dome-shaped top 104. A plurality of slots 106 are disposed within the body 102. A plurality of perpendicularly-extending axial collet fingers 108 are defined by the slots 106. The collet fingers 108 each include an outward radial protrusion 110 that has an upwardly facing stop face 112 that is oriented perpendicularly with respect to the axis of the cap 100. The protrusion 110 also presents a downwardly-facing cam face 114 that is oriented at an angle to the longitudinal axis of the cap 100. The cylindrical body 102 also includes a plurality of lateral fluid ports 116.

The cap 100 is normally seated in a "lower" position, as shown particularly in FIGS. 1 and 4, such that the dome-shaped top 104 is resting upon the upper plate 32. In this position, the lateral ports 116 are covered by edges of openings and the slots 106 are disposed below the plates 32, 64. In this lower position, fluid is not communicated across the valve through either the ports 116 or the slots 106.

It should be understood that excessive fluid pressure below the cap 100 will cause the cap 100 to move upwardly within the openings 38, 68 until the stop faces 112 on the protrusions 110 of the collet fingers 108 engage the lower plate 64. In this upper position, the lateral ports 116 are raised above the plates 32, 64 and are uncovered so that fluid may be communicated through them. In addition, portions of the slots 106 become disposed above the plates 32, 64 so that fluid can be communicated through them as well.

In operation, the cap 100 permits venting of excessive wellbore pressures below the valve when the mud pumps are shut off. When these pumps are shut off, the pressure below the valve may exceed the pressure provided by standing mud above the valve 100. This higher pressure will cause the vent cap 100 to move upwardly so that the excess pressure will escape through the slots 106 within the body 102 and lateral ports 116 and be transmitted through the kelly to a pressure gauge (not shown). The vent cap 100 thus also allows standpipe pressure to be read when the mud pumps are turned off. The dome shape of the top 104 assists in directing downwardly-pumped fluids toward the fluid passages formed by apertures 40, 70.

The vent cap 100 is easily inserted into the valve but cannot be easily removed. Insertion of the cap 100 into the valve is accomplished by aligning the cap 100 with the openings 38, 68 in the two circular plates 32, 64 and pushing the cap 100 downwardly. The edge of the upper opening 38 will engage the cam faces 114 of the collet fingers 108 urging them radially inward and permitting the protrusion 110 to pass through both openings 38, 68.

The presence of the stop face 112 on each of the collet fingers 108 will prevent withdrawal of the cap 100 from the openings 38, 68. If the cap 100 is lifted upwardly, the stop faces 112 will engage the lower side of the plate 64 in a mating relation.

If desired to destroy the vent cap 100, a sinker bar can be dropped into the well to break the cap 100. The cap 100 will be destroyed, permitting a wireline tool to be passed through the openings 38, 68 of the plates 32, 64. The cap 100 can be easily replaced by inserting a new cap into the openings 38, 68 in the manner described.

While various preferred embodiments of the invention have been shown and described, modifications thereof can be made by one skilled in the art without departing from the spirit and teachings of the invention. The embodiments described herein are only exemplary and are not limiting. Many variations in modifications of the invention and apparatus disclosed herein are possible and are within the scope of the invention. Accordingly, the scope of protection is not limited by this description set out above, but is only limited by the claims which follow, that scope, including all the equivalence of the subject matter of the claims.

What is claimed is:

1. A frangible vent cap for a kelly valve comprising:

a) a frangible central body; and b) at least one perpendicularly-extending collet finger having a radially-outwardly protruding lip to facilitate insertion of the vent cap into a surrounding opening and to prevent withdrawal of the vent cap from the surrounding opening.

2. The vent cap of claim 1 wherein there are a plurality of collet fingers disposed in a generally circular pattern.

3. The vent cap of claim 1 further including a plurality of radially disposed fluid ports to permit venting of fluid under pressure.

4. The vent cap of claim 2 wherein the radially protruding lip of each of the collet fingers further comprises a stop face to resist removal of the cap from the surrounding opening.

5. The vent cap of claim 4 wherein each protruding lip further presents an angled camming face to cam the collet fingers radially inward for passage through the surrounding opening.

6. The vent cap of claim 1 further comprising a dome-shaped top portion.

7. The vent cap of claim 2 wherein the collet fingers are defined by a plurality of slots in the central body of the cap.

8. The vent cap of claim 1 wherein the vent cap is not connected to the kelly valve.

9. The vent cap of claim 1 wherein the protruding lip further includes a plurality of surface means that facilitate insertion of the vent cap and prevent withdrawal of the vent cap from the surrounding opening.

10. The vent cap of claim 3 wherein the fluid does not flow through the ports when the vent cap is in a first position and the fluid is vented through the ports when the vent cap is in a second position.

11. The vent cap of claim 3 wherein the protruding lip maintains the vent cap within the surrounding opening when the fluid is vented through the ports.

12. The vent cap of claim 1 further including a plurality of slots to permit venting of fluid under pressure.

13. The vent cap of claim 12 wherein the fluid does not flow through the slots when the vent cap is in a first position and the fluid is vented through the slots when the vent cap is in a second position.

14. The vent cap of claim 12 wherein the protruding lip maintains the vent cap within the surrounding opening when the fluid is vented through the slots.

15. The vent cap of claim 6 wherein the top portion directs fluid to one or more ports in the kelly valve.

16. A vent cap comprising:

a frangible central body;

means to facilitate insertion of the vent cap into a surrounding opening;

means to prevent removal of the vent cap from the surrounding opening; and means for venting a fluid under pressure through the vent cap;

wherein the frangible central body is not removeable from the means to facilitate insertion or from the means to prevent removal.

* * * * *